United States Patent [19]

Doyel

[11] Patent Number: 4,479,684

[45] Date of Patent: Oct. 30, 1984

[54] NESTING DRAWER ASSEMBLY

[76] Inventor: John S. Doyel, 404 W. 20th St., New York, N.Y. 10011

[21] Appl. No.: 392,357

[22] Filed: Jun. 25, 1982

Related U.S. Application Data

[63] Continuation-in-part of Ser. No. 374,188, May 3, 1982, abandoned.

[51] Int. Cl.[3] ..... A47B 63/00

[52] U.S. Cl. ..... 312/330 R; 206/425; 206/499; 206/515; 206/518; 211/50; 220/345; 312/193; 312/246

[58] Field of Search ..... 312/246, 183, 193, 9, 312/107, 330 R; 211/50; 206/515, 499, 425, 518; 220/345, 351

[56] References Cited

U.S. PATENT DOCUMENTS

| | | | |
|---|---|---|---|
| 512,496 | 1/1894 | Autenrieth | 312/111 |
| 2,056,853 | 10/1936 | Hedges | 312/107 |
| 2,796,310 | 6/1957 | Anderson | 312/246 |
| 2,929,530 | 3/1960 | Sargent | 220/345 |
| 3,351,404 | 11/1967 | Blake | 312/246 |
| 4,012,087 | 3/1977 | Edwards, Jr. | 206/425 |
| 4,057,166 | 11/1977 | Yamazaki et al. | 220/345 |
| 4,105,270 | 8/1978 | Bergkamp et al. | 312/193 |
| 4,178,049 | 12/1979 | Loo | 312/348 |
| 4,184,725 | 2/1980 | Spangler | 312/348 |

FOREIGN PATENT DOCUMENTS

| | | | |
|---|---|---|---|
| 1210412 | 10/1960 | Fed. Rep. of Germany | 312/183 |
| 2206747 | 2/1972 | Fed. Rep. of Germany | 312/284 |
| 1473157 | 1/1966 | France | 220/351 |

*Primary Examiner*—William E. Lyddane
*Assistant Examiner*—Thomas A. Rendos
*Attorney, Agent, or Firm*—Cooper, Dunham, Clark, Griffin & Moran

[57] ABSTRACT

Disclosed is a drawer assembly having a drawer top and bottom which interlock for sliding movement relative to each other and easily disassemble by hand and nest within each other to nearly half the assembled size to thereby facilitate shipment or storage. A door, snap-mounted to the assembly, pivots frictionally to provide a convenient ledge for a recipe card.

11 Claims, 11 Drawing Figures

Fig. 6.
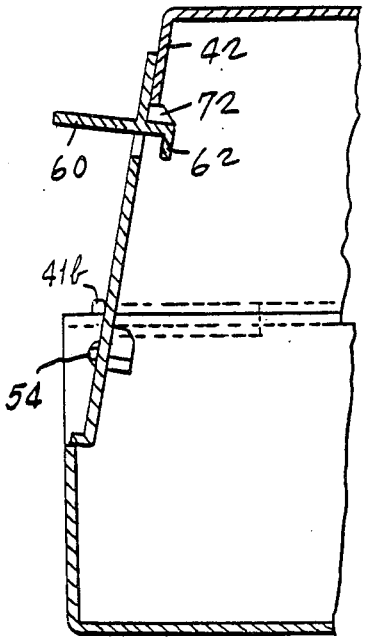
Fig. 7.
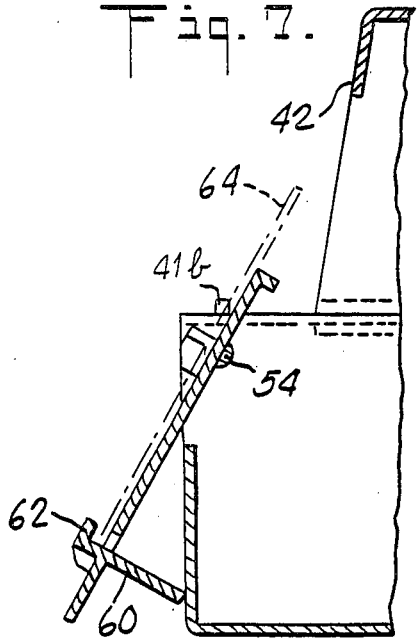
Fig. 8.
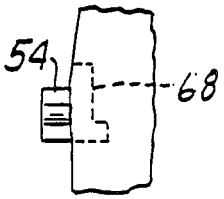
Fig. 9.
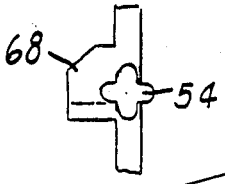
Fig. 10.
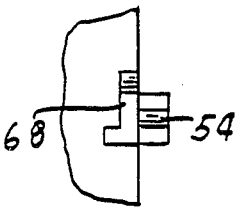
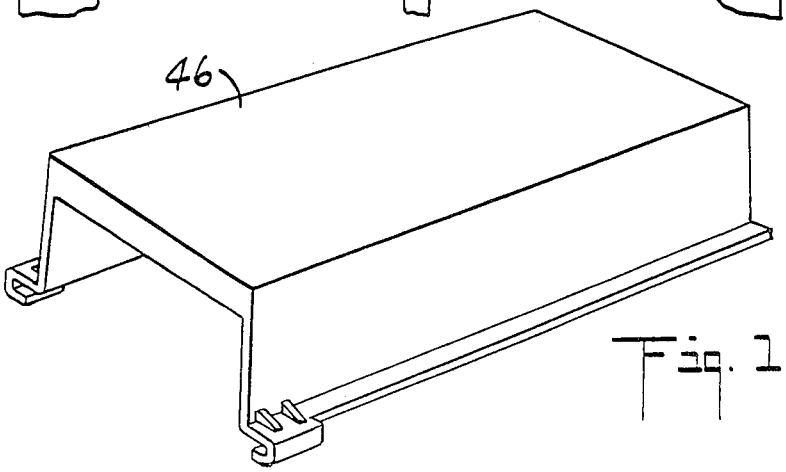
Fig. 11.

NESTING DRAWER ASSEMBLY

REFERENCE TO RELATED APPLICATION

This application is a continuation-in-part of parent application Ser. No. 374,188 filed on May 3, 1982, now abandoned, the entire disclosure of which is hereby incorporated by reference in this c-i-p application.

BACKGROUND AND SUMMARY OF THE INVENTION

The invention relates to drawers, for example, those used for sheet stock such as recipe cards, and to table top drawers as well as drawers mounted to the underside of cabinets or shelves.

There is a wide variety of drawers used for card recipes, and one example is proposed in U.S. Pat. No. 4,105,270. As with many items for household or kitchen use, it is desirable that such drawers be sturdy and easy to use and yet be light and inexpensive, that they have large capacity and yet be small for easy storage and inexpensive shipment, that they be easy to assemble and disassemble without tools and yet have their pieces remain securely interlocked once assembled. In applicant's view, the prior art known to him has not met these conflicting requirements satisfactorily, and this invention pertains to doing so in a particularly advantageous manner.

In a specific and nonlimiting example, the invention is embodied in a drawer assembly for recipe cards which is mounted to the underside of a cabinet or a shelf. It comprises a drawer top which mounts to the underside of a cabinet or shelf, a drawer bottom which slideably interlocks therewith, and a door pivotally mounted to the front of the drawer bottom to provide a hand-pull and, when pivoted to an open position, a ledge to support a selected recipe card. The assembly is easily taken apart by deforming by hand the drawer bottom's sidewall to remove the door and similarly deforming the sidewalls of the drawer top and/or bottom to disengage them from each other. Once disassembled, the drawer top, which is slightly smaller, completely nests in the drawer bottom to thereby reduce the assembly size by nearly half, and thereby allow the disassembled item to be packaged in a cardboard box about half the assembled size, with attendant savings in shipping and storage costs—a particularly important consideration for items often marketed through mail-order houses. While the walls of all three parts and quite thin, to save material and to reduce shipping weight, structural stiffness is assured by ribs and ridges which serve additional functions as well. For use, the three parts are easily assembled by hand: by mounting the drawer top to the underside of a cabinet or shelf, interlocking the drawer bottom therewith and then snapping the door in place. They can be similarly disassembled.

Both the drawer bottom and the drawer top are in the shape of rectangular trays and, when assembled, the top tray is upside down. The free margins of the sidewalls of the top and bottom have flanges, and the drawer bottom has at its back end a pair of brackets which slideably engage the flanges on the drawer top. The drawer top has similar brackets at its front end which similarly slideably engage the flanges the drawer bottom has, to thereby interlock the two to each other but allow sliding back-and-forth movement therebetween. The two pairs of brackets are in each other's way in said movement, to thereby limit the extent of the bottom's movement forwardly relative to the top. The bottom's movement back relative to the top is limited by a pair of stops which extend up from the front ends of the bottom's flanges and engage the top's brackets. A ridge extends downwardly from the inner side of each of the top's flanges, to fit just inside the bottom's flanges and thus to serve as both a guide and as a stiffening rib. The door pivots about a horizontal axis between a closed position, in which it is releasably snap-locked to the drawer top, and any one of a range of open positions. It remains in any selected open position because of its frictional mount to the drawer bottom. It has a drawer pull extending forwardly therefrom when it is in its closed position, and has at its other side a ledge which supports a selected recipe card when the door is pivoted to a position in which the door pull points downwardly or to the rear. Because of the door's frictional mount, the card can be easily adjusted to remain at an angle convenient to the user. Vertical tracks are provided in the facing sidewalls of the drawer bottom, and a card backstop can be fitted in a selected pair of tracks to support a stack of recipe cards.

When the assembly is for mounting to the underside of a shelf or cabinet, the top wall of the drawer top can be reduced to the marginal portion thereof, whereby weight and material are saved. The remaining marginal portion provides structural stability and can have holes for mounting screws. When the drawer assembly is to be used as a table top unit, the top wall of the drawer top can be continuous, and need not have mounting screw holes.

BRIEF DESCRIPTION OF THE DRAWINGS

FIG. 6 is a partial sectional view of the front end of the closed drawer assembly.

FIG. 7 is a sectional view similar to that of FIG. 6 but showing the door in an opened position.

FIGS. 8, 9 and 10 are partial views of a pin in the door for journaling it to the drawer bottom.

FIG. 11 is a perspective view of an alternate drawer top for use of the assembly as a table top item.

DETAILED DESCRIPTION

Figure 1:
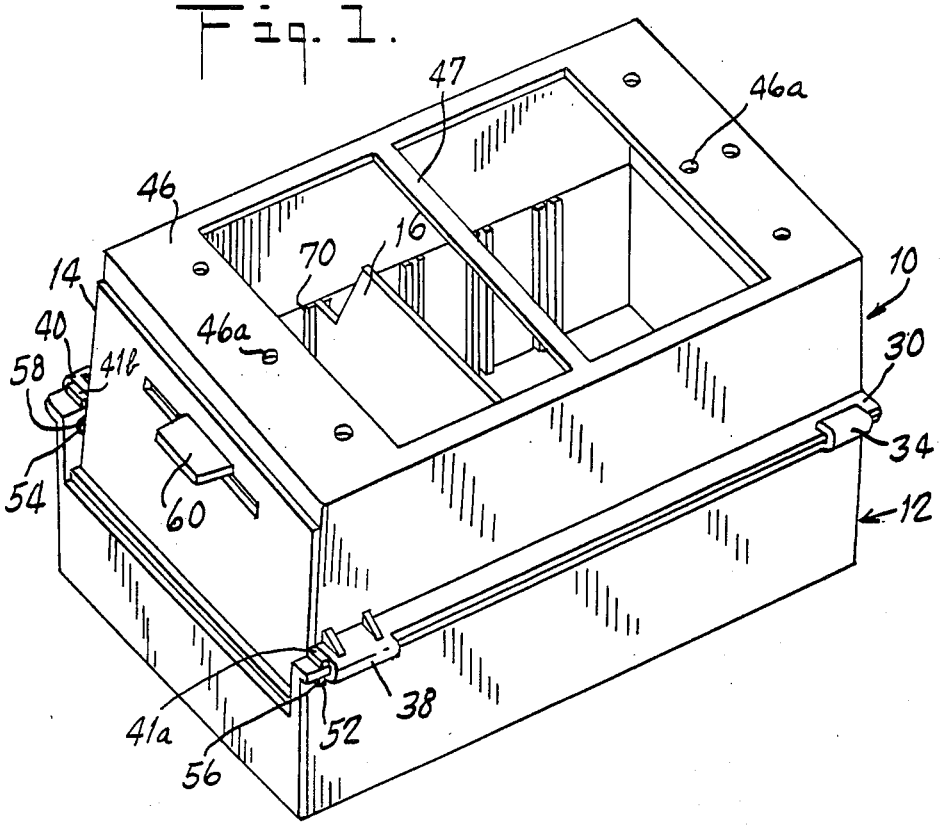
FIG. 1 is a perspective view of a drawer assembly serving as an exemplary embodiment of the invention.
Figure 2:
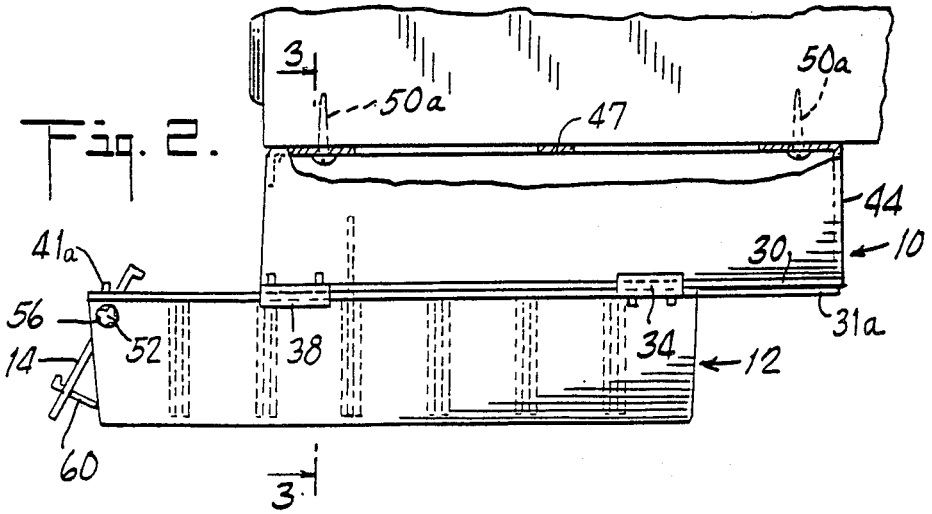
FIG. 2 is a partly elevational and partly sectional view of the drawer assembly as mounted to the underside of a cabinet and with the drawer bottom partly open and the drawer door pivoted to support a recipe card.

The illustrated exemplary nesting drawer assembly comprises a drawer top 10, drawer bottom 12, door 14 and cardstop 16. The drawer bottom has a pair of upwardly extending facing sidewalls 18 and 20 having flanges 22 and 24 at their upper margins, and the drawer top has a pair of downwardly extending facing sidewalls 26 and 28 with matching flanges 30 and 32 along their lower margins. The drawer bottom has at its back end a pair of brackets 34 and 36 slideably engaging the drawer top flanges 30 and 32, and the drawer top has at its front end a pair of brackets 38 and 40 which in turn slideably engage the drawer bottom flanges. The interlocking flanges and brackets allow relative back-and-forth sliding movement between the drawer bottom and top, but the two pairs of flanges are in each other's path in said movement, to thereby limit the extent thereof in the direction of the bottom's forward movement relative to the top, e.g. when the bottom is pulled forwardly, as is partly done in FIG. 2. The extent of the bottom's back movement relative to the top is limited by a pair of stops or projections 41*a* and 41*b*, which extend upwardly from the front ends of flanges 22 and 24, respectively, and engage brackets 38 and 40, respectively, when bottom 12 is pushed back relative to top 10 to the position shown in FIG. 1. The drawer top has a partial front wall 42, a back wall 44 and, in the embodiment for mounting to the underside of a shelf or cabinet, only the marginal portion of a top wall 46. In the embodiment for table top use (FIG. 11) the top wall 46 is continuous so as to completely enclose the drawer assembly. In the embodiment of FIG. 1, top wall 46 has screw holes, as in 46*a*, for mounting the drawer top to the underside of a shelf or a cabinet with screws such as 50*a* as illustrated in FIG. 2. Most of the central portion of the top wall 46 is omitted, to save weight and material, as the marginal portions provide adequate structural rigidity. A central band 47, spanning the opening, can be left in for additional rigidity. A pair of longer screws, and spacer sleeves, can be used in case the top has to be mounted on a stepped underside of a shelf or cabinet.

Door 14 is journaled to the front end of drawer bottom 12 by pins 52 and 54, one of which is shown in greater detail in FIGS. 8, 9 and 10, and which fit in respective holes 56 and 58 in sidewalls 18 and 20 of the drawer bottom, to allow door 14 to rotate about a horizontal axis between the closed position illustrated in FIGS. 1 and 6 and a range of open positions, the extreme one of which is illustrated in FIGS. 2 and 7. Door 14 has a hand-pull 60 which extends forwardly when the door is in its closed position and has, at its other side, a ledge 62, which is L-shaped in section (FIG. 7) so as to support a recipe card 64 when the door is in an open position. The fit of door pins 52 and 54 in holes 56 and 58 respectively and/or the fit of door 14 between sidewalls 18 and 20 of the drawer bottom is tight so as to cause sufficient friction for the door to remain at any one of its range of open positions. This frictional mount allows a user to have the door, and the card supported by its ledge, tilted to and remaining at any convenient angle in said range of open positions. The door also serves as an additional stop limiting the extent of backward movement of the drawer bottom relative to the drawer top. When the door is in its position in FIG. 7 or in any position between that and near horizontal, the part thereof facing the drawer top is large enough to engage it when the drawer bottom is pushed in far enough. When door 14 is horizontal or nearly horizontal, lugs 66 and 68 are aligned with stops 41*a* and 41*b* and can engage the drawer top when the drawer bottom is pushed in far enough, and when door 14 is between its closed position and about horizontal, the part thereof facing the drawer top is large enough to engage it when the drawer bottom is pushed in far enough. In addition, door 14 has lugs 72 at its rear upper margin which releasably snap-lock to front wall 42 of drawer top 10 to keep the assembly securely closed when it is not in use.

Cardstop 16 fits in a selected one of a pair of vertically extending tracks in sidewalls 18 and 20. As illustrated in FIG. 1, it is in a track 70 in sidewall 20 and a corresponding track (not visible) in sidewall 18, and can be lifted up therefrom and fitted in any other such pair of tracks to support the desired quantity of recipe cards kept in the drawer assembly.

Ridges 31*a* and 32*a* extend downwardly from the inner margins of flanges 30 and 32 respectively, and fit just inside of sidewalls 18 and 20 of bottom 12, to slide therealong, just clearing the tops of tracks 70 in sidewall 20 and the corresponding tracks in sidewall 18. Ridges 31*a* and 32*a* help top and bottom 10 and 12 stay together in use, help them slide smoothly relative to each other, and help provide enough structural rigidity and stiffness despite the thin material used in the walls of top 10 and bottom 20. The back wall of bottom 12 has a pair of notches 34*a* and 36*a* into which ridges 31*a* and 32*a* fit freely. Ridges 31*a* and 32*a* can extend along the entire length of flanges 30 and 32, but preferably start just behind brackets 38 and 40, to thereby facilitate assembly and disassembly of the unit.

Figure 3:
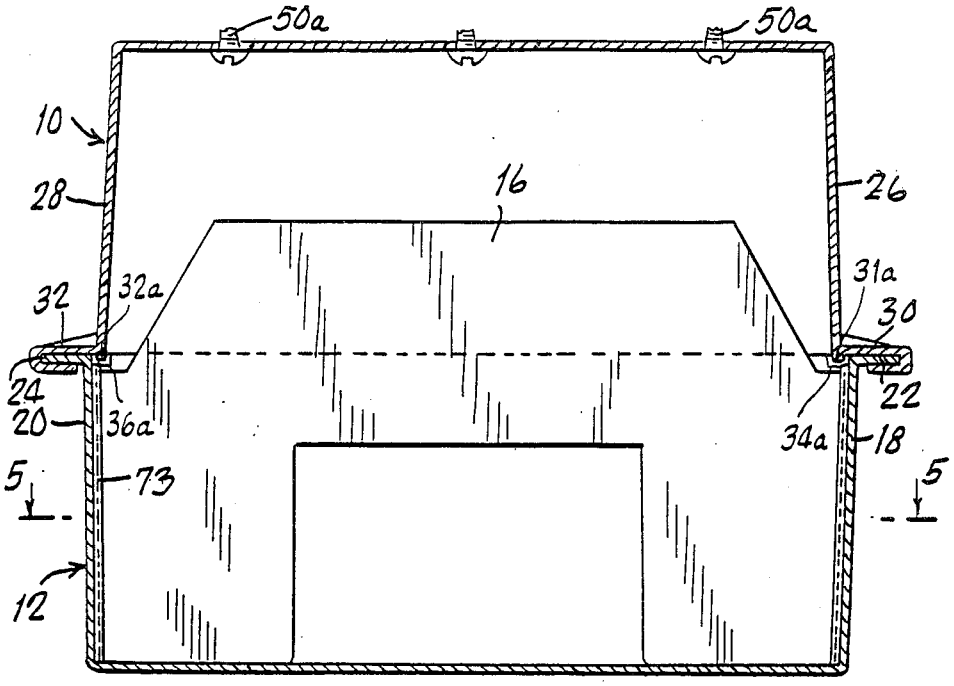
FIG. 3 is a sectional view along lines 3—3 of FIG. 2.
Figure 5:
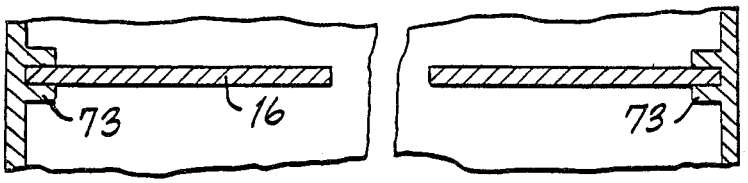
FIG. 5 is a partial sectional view along lines 5—5 of FIG. 3.
Figure 4:
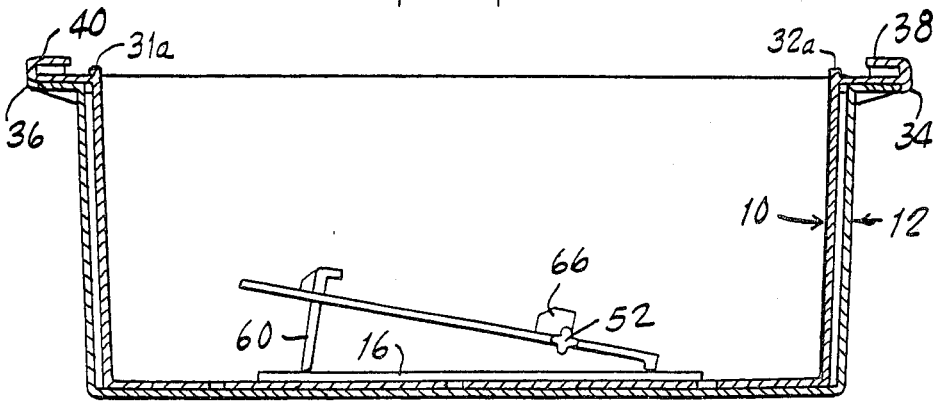
FIG. 4 is a sectional view of the disassembled and nestled drawer assembly.

A particularly convenient and important feature of the drawer assembly is that when disassembled, the top nestles in the bottom as illustrated in FIG. 4, to thereby reduce the assembly to about half (meaning less than, say, two-thirds) its assembled size. The four separate pieces of the assembly are typically molded from thermoplastic material and are nestled as illustrated in FIG. 4 for storage and shipment in a cardboard box. For use under a counter or a shelf, the drawer top is fastened thereto, as illustrated in FIG. 2, the sidewalls of the drawer top and bottom are suitably deformed by hand, as they are somewhat resilient, to snap the brackets of one onto the flanges of the other, as in the relative position illustrated in FIGS. 1–3, and the door is secured by spreading apart the front ends of sidewalls 18 and 20 until pins 52 and 54 can snap in place (or can be forced) into holes 56 and 58. Cardstop 16 is then lowered in the selected pair of tracks, and the drawer assembly is ready for use. The assembly procedure is similar for the embodiment used as a table top item (with the drawer top shown in FIG. 11). The unit can be similarly disassembled by hand, through deforming the sidewalls to snap the flanges out of the brackets and to snap the door pins out of their holes in sidewalls 18 and 20.

Of course, directional terms such as horizontal, vertical, forward, etc., relate to a particular orientation of the assembly, and have no other limiting significance.

I claim:

1. A nesting drawer assembly for storing material such as recipe cards comprising:

a drawer bottom with a pair of upwardly extending facing sidewalls flanged at their upper margins and a drawer top with a pair of downwardly extending facing sidewalls with matching flanges along their lower margins, the drawer bottom having at its back end a pair of brackets slideably engaging around the drawer top flanges and the drawer top having at its front end a pair of brackets slideably engaging around the drawer bottom flanges to thereby allow relative back-and-forth sliding movement between the drawer bottom and top, the two pairs of brackets being in each other's path in said movement to limit the extent thereof in the direction of the bottom's forward movement, with the top's flanges being over and riding on the bottom's flanges and with the brackets holding the top and bottom to each other;

said drawer bottom and top being shaped and dimensioned to receive selected flat stock therein when said brackets engage the respective flanges, and at least one of the bottom and top being made of resilient material to allow the sidewalls thereof to be manually deformed to thereby disengage the drawer bottom and top from each other; and said drawer top and bottom being shaped and dimensioned relative to each other to allow one to nest in the other when so disengaged from each other to thereby reduce the assembly to about half its assembled size to facilitate shipment or storage thereof.

2. A nesting drawer assembly as in claim 1 including a door journaled at the front end of the drawer bottom to rotate about a horizontal axis between a closed position and a range of open positions.

3. A nesting drawer assembly as in claim 2 in which the door's journaled movement causes sufficient friction with the drawer bottom to retain the door at any one of a range of the open positions to which it can be manually rotated.

4. A nesting drawer assembly as in claim 2 or 3 in which said door has a hand-pull extending forwardly thereof when the door is in its closed position, and a card ledge at the side thereof opposite said pull to support a recipe card when the door is rotated about said horizontal axis to a position in which said pull extends downwardly or backwardly.

5. A nesting drawer assembly as in claim 2 or 3 in which said door includes one or more lugs releasably snap-locking the door to the drawer top when the door is in its closed position.

6. A nesting drawer assembly as in claim 2 or 3 in which said door includes means limiting the extent of the backward sliding movement of the drawer bottom relative to the drawer top.

7. A nesting drawer assembly as in claim 2 or 3 in which the drawer top includes a back wall, a partial front wall and a top wall with at least one substantial opening therein, and includes means for mounting the drawer top to the underside of a shelf or a cabinet.

8. A nesting drawer assembly as in claim 7 in which said drawer bottom includes a back wall, a bottom wall and a partial front wall and in which the door is shaped and dimensioned to close the gap between the sidewalls and the partial front walls of the drawer top and bottom when in its closed position.

9. A nesting drawer assembly as in claim 1 in which the facing sides of the drawer bottom's sidewalls have vertically extending tracks spaced from each other in the front-to-back direction, and including a card stop removably retained in a selected facing pair of said tracks.

10. A nesting drawer assembly as in claim 2 or 3 in which the front ends of the bottom's flanges have upwardly extending stops which are in the path of the top's brackets to engage them and thereby limit the extent of the backward movement of the drawer bottom relative to the drawer top.

11. A nesting drawer assembly as in claim 2 or 3 in which one of the top and bottom has ridges extending from the inner margin of its flanges toward and along the inner sides of the flanges of the other, to interlock the top and bottom to each other in their sliding movement.

* * * * *